US008166859B2

(12) United States Patent
Angevine

(10) Patent No.: US 8,166,859 B2
(45) Date of Patent: May 1, 2012

(54) PAPER TRIMMER

(76) Inventor: Faye Angevine, Taipei (TW)

( * ) Notice: Subject to any disclaimer, the term of this patent is extended or adjusted under 35 U.S.C. 154(b) by 663 days.

(21) Appl. No.: 12/331,168

(22) Filed: Dec. 9, 2008

(65) Prior Publication Data

US 2009/0145278 A1 Jun. 11, 2009

Related U.S. Application Data

(60) Provisional application No. 61/012,720, filed on Dec. 10, 2007.

(51) Int. Cl.
*B26D 7/02* (2006.01)

(52) U.S. Cl. ..... 83/455; 83/565; 83/614

(58) Field of Classification Search ..... 83/454, 83/455, 565, 613, 614, 743, 745, 761, 821; 30/289, 290, 294
See application file for complete search history.

(56) References Cited

U.S. PATENT DOCUMENTS

| | | | | |
|---|---|---|---|---|
| 318,556 | A | | 5/1885 | French |
| 357,678 | A | * | 2/1887 | Maxwell ..... 83/413 |
| 442,414 | A | | 12/1890 | Blanchard |
| 491,307 | A | | 2/1893 | Gaylord |
| 802,720 | A | | 10/1905 | Weber |
| 802,721 | A | | 10/1905 | Weber |
| 821,299 | A | | 5/1906 | Lovoie |
| 821,681 | A | | 5/1906 | Vandemark et al. |
| 1,075,050 | A | | 10/1913 | Mihills |
| 2,327,223 | A | | 8/1943 | Silver |
| 2,345,450 | A | | 3/1944 | Blanc |
| 2,672,933 | A | | 3/1954 | Bridy |
| 2,790,498 | A | | 4/1957 | Carscallen |
| 3,237,497 | A | | 3/1966 | Cook |
| 3,301,117 | A | | 1/1967 | Spaulding |
| 3,527,131 | A | | 9/1970 | Ellerin et al. |
| 3,648,557 | A | | 3/1972 | Lind |
| 3,973,459 | A | | 8/1976 | Stowe |
| 4,840,097 | A | * | 6/1989 | Campbell ..... 83/829 |
| 4,957,235 | A | | 9/1990 | Beno et al. |
| 4,967,628 | A | | 11/1990 | Judd et al. |
| D319,255 | S | | 8/1991 | Beno et al. |
| D319,840 | S | | 9/1991 | Hatsumi et al. |
| 5,069,097 | A | | 12/1991 | Mori |
| D322,974 | S | | 1/1992 | Mori |
| 5,322,001 | A | | 6/1994 | Boda |
| D353,150 | S | | 12/1994 | Mori |
| D360,891 | S | | 8/1995 | Birkholz |
| D360,892 | S | | 8/1995 | Birkholz et al. |
| 5,524,515 | A | | 6/1996 | Boda |
| D377,368 | S | | 1/1997 | Rellinger |
| D379,193 | S | | 5/1997 | Cornell |
| D381,359 | S | | 7/1997 | Mori |
| D387,377 | S | | 12/1997 | Daley |

(Continued)

*Primary Examiner* — Edward Landrum
(74) *Attorney, Agent, or Firm* — Morriss O'Bryant Compagni, PC

(57) ABSTRACT

Methods, systems and components for paper trimmers cut paper placed on a planar base using a blade that is moved transversely across the paper. A recessed cutting track containing a desired cutting pattern is inserted into the planar base and a counterpart guide track suspended thereover. A blade assembly is inserted through a channel in the guide track with the cutting blade residing in the counterpart channel in the cutting track. Material to be trimmed is placed between the recessed cutting track and the guide track. As the blade assembly is directed along the length of the counterpart channels, guides on the blade assembly interact with the channel and cause the cutting blade to rotate, cutting along the path of the channel. Desired cuts are made by selecting appropriate interchangeable cutting tracks and counterpart guide tracks.

12 Claims, 12 Drawing Sheets

U.S. PATENT DOCUMENTS

| | | | | |
|---|---|---|---|---|
| 5,802,942 | A * | 9/1998 | Cornell et al. | 83/455 |
| 5,819,618 | A | 10/1998 | Rodriguez | |
| D412,931 | S | 8/1999 | Chan et al. | |
| D415,404 | S | 10/1999 | Seaton | |
| D417,693 | S | 12/1999 | Daley, Jr. | |
| D425,548 | S | 5/2000 | Rellinger | |
| D427,626 | S | 7/2000 | Robillard | |
| 6,098,515 | A * | 8/2000 | Daley, Jr. | 83/485 |
| 6,216,577 | B1 * | 4/2001 | Lira-Nunez et al. | 83/745 |
| 6,401,343 | B1 * | 6/2002 | Hsu | 30/293 |
| 6,460,443 | B1 | 10/2002 | Hsiao | |
| D469,461 | S | 1/2003 | Gstalder | |
| D469,800 | S | 2/2003 | Robillard | |
| 6,675,689 | B2 * | 1/2004 | Nunez et al. | 83/745 |
| D503,191 | S | 3/2005 | Mori et al. | |
| 6,931,974 | B2 * | 8/2005 | Tseng | 83/699.11 |
| 6,951,058 | B2 * | 10/2005 | McLean et al. | 33/27.12 |
| 6,951,159 | B2 * | 10/2005 | Lin et al. | 83/620 |
| 7,040,208 | B2 * | 5/2006 | Mori et al. | 83/563 |
| D535,685 | S | 1/2007 | Gunter | |
| D536,367 | S | 2/2007 | Gunter | |
| 7,299,731 | B2 | 11/2007 | Schulz | |
| D569,416 | S | 5/2008 | Ayala | |
| 2002/0134213 | A1 * | 9/2002 | Causse et al. | 83/565 |
| 2003/0140757 | A1 | 7/2003 | Carlson et al. | |
| 2003/0140761 | A1 * | 7/2003 | Schulz | 83/614 |
| 2003/0183058 | A1 * | 10/2003 | Fan et al. | 83/455 |
| 2004/0034361 | A1 | 2/2004 | Dalton | |
| 2004/0149108 | A1 | 8/2004 | McLean et al. | |
| 2004/0221705 | A1 | 11/2004 | Vossler | |
| 2005/0034584 | A1 | 2/2005 | Antal et al. | |
| 2007/0277663 | A1 * | 12/2007 | Eby et al. | 83/651 |

* cited by examiner

PAPER TRIMMER

CROSS-REFERENCE TO RELATED APPLICATIONS

This application claims priority to Provisional U.S. Patent Application Ser. No. 61/012,720, filed on Dec. 10, 2007.

FIELD OF THE INVENTION

The present invention relates generally to paper trimmers and more particularly to a personal paper trimmer in which a carrier holding a blade is slidably traversed in a slot of a plate across paper or other sheet-like material to be cut.

BACKGROUND OF THE INVENTION

Traditional paper trimmers include "guillotine-type" cutters with an elongated blade pivotally attached to one end of a cutting board. In use, the elongated blade is lowered about a pivot, thereby cutting a paper or material by shearing action. The elongated blade is often exposed, which may pose a hazard for a user. The overall size of such cutters additionally makes them difficult to easily and conveniently transport. Other types of conventional paper trimmers include a blade attached to a carrier which is translated along a rail assembly. The rail assembly may be pivoted to permit loading and unloading of the material to be cut or may be stationary.

Both types of conventional paper trimmers are designed to make straight cuts across paper, whether by using a rotary cutter attached to a wheel or a pivoting guillotine-type blade. A paper trimmer that included a base board for securing the paper to be cut and that was capable of making multiple types of cuts would be an improvement in the art.

SUMMARY OF THE INVENTION

The present invention is direct to methods, systems and components for paper trimmers which cut paper placed on a planar base using a blade that is moved transversely across the paper. In some illustrative embodiments, a recessed cutting track containing a desired cutting pattern may be inserted into the planar base and a counterpart guide track suspended thereover. A blade assembly is inserted through a channel in the guide track with the cutting blade residing in the counterpart channel in the cutting track. Material to be trimmed may be placed atop the planar base between the recessed cutting track and the guide track. As the blade assembly is directed along the length of the counterpart channels, guides on the blade assembly interact with the channel and cause the cutting blade to pivot or rotate, cutting along the path of the channel. Desired cuts may be made by selecting appropriate interchangeable cutting tracks and counterpart guide tracks.

DESCRIPTION OF THE DRAWINGS

The foregoing summary, as well as the following detailed description of the preferred embodiments is better understood when read in conjunction with the appended drawings. It should be noted that while common elements contained in the drawings may have the same reference number, such structures may have different configurations and form separate embodiments. For the purpose of illustrating the invention, there is shown in the drawings embodiments that illustrate what is currently considered to be the best mode for carrying out the invention, it being understood, however, that the invention is not limited to the specific methods and instruments disclosed. In the drawings.

DETAILED DESCRIPTION OF THE ILLUSTRATED EMBODIMENTS

Further detailed description is made for the present invention by combining the embodiment and attached figures, but the operation process of this invention is not limited to the following embodiment.

Figure 1:
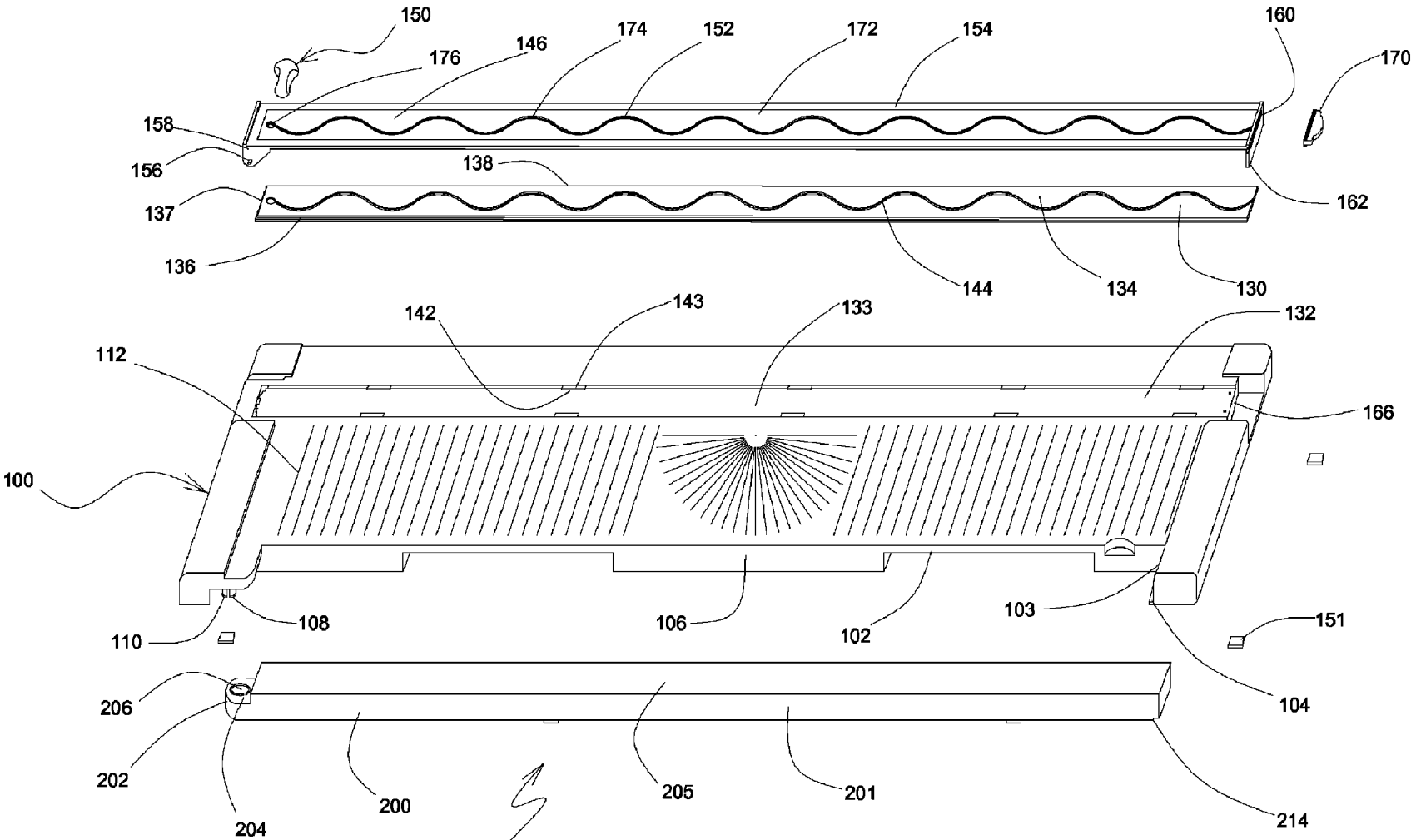
FIG. 1 is an exploded perspective view of one illustrative embodiment of a paper trimmer system in accordance with the principles of the present invention.

FIG. 1 shows one embodiment of a paper trimmer assembly, generally indicated at 10, in accordance with the principles of the present invention. As depicted, assembly 10 includes base 100 which may be formed as a member having a planar top surface 101. Top surface 101 is used to support paper or another sheet-like material during cutting and may include indicia 112, such as grid lines spaced apart in fractions of inches or in centimeters and/or an angular array to assist in angular orientation to assist a user in making desired cuts. For example, such indicia may include measurement markings, angle lines, and the like that may be used to align the material to be cut in a desired manner. Where base 100 is formed from a polymeric material, such as a plastic, the indicia 112 may be formed into the top surface 101. Alternatively, the indicia may be placed on the surface 101 by marking with paint, or as is otherwise known to those of skill in the art.

A side ruler 200 may be pivotally attached to the base 100 along a first long edge 102. As shown in FIG. 1, side ruler 200 may be formed as a body 201 including an elongated member having an upper surface 205 with measuring indicia formed therein. At a proximal end 202, a recessed area 204 of the upper surface 205 may include a through-hole 206, which can serve as a pivot point for attaching the side ruler 200 to the base 100 by attachment to a complementary protrusion 110 on the base 100. A plurality of feet 151, comprised of rubber pads, are attached to the bottom surface of the base 100 and the side ruler 200 to prevent the trimmer 10 from damaging a support surface, such as a table and also to prevent the trimmer 10 from sliding during use.

As depicted in FIG. 1, the first long edge 102 of a base 100 may include an inset 103 for receiving side ruler 200. An inner wall 106 of inset 103 may include one or more structures for releasably securing the side ruler 200 in place within the inset 103, such as one or more bumps 104 which reside in a friction fit within corresponding recesses 214 (FIG. 1) in the side ruler. A section of the underside of base 100 may include a recess 108 where the pivot for the side ruler 200 may be attached to a protrusion 110. It will be appreciated that embodiments of the present invention which include a base 10 without a side ruler 200 are contemplated and within the scope of the present invention.

Configured for attaching to the top surface 101 of the base is a cutting track 130. The cutting track 130 is receivable within similarly sized and shaped recess 132 formed in the top surface 101 of the base 100, such that the top surface 134 of the cutting track 130 is substantially flush with the top surface 101 when properly inserted in the base 100. In order to retain the cutting track 130 within the base 100, the cutting track 134 is provided with stepped edges 136, 137 and 138 that slidably engage with protrusions 143 that form channels 142 between the protrusions 143 and the bottom surface 133 of the recess 132 to engage and retain the stepped edges 136, 137 and 138 of the cutting track 130. The cutting track 130 also includes a longitudinally extending cutting groove 144 that defines a blade path for receiving a cutting blade of a paper trimmer blade assembly 150. As will be discussed in more detail herein, as the blade from the blade assembly passes along the cutting groove 144, paper positioned above the cutting track 130 is held in place over the cutting groove 144 so that the blade can easily cut the paper in the shape of the groove 144.

With the cutting track 130 in place, a guide track 146 for guiding the blade assembly 150 along a predetermined path 152 is positioned over the cutting track 130. The guide track 146 is removably attached to an elongate mounting frame 154 in a manner similar to the mounting of the cutting track 130 to the base 100. That is, the mounting frame 154 includes longitudinally extending internal channels (not visible) for receiving and maintaining stepped side edges (not visible) of the guide track 146. The mounting frame 154 includes a pair of laterally extending protrusions 156 depending from a pivoting end 158 of the mounting frame 154 for pivotally mounting the mounting frame 154 to the base 100. At the other end 160 of the mounting frame 154, a retaining portion 162 is configured to engage in a friction-type fit with an edge 166 of the base 100 to releasably engage the frame 154 with the base 100. End member 170 is configured to attach to the end 160 of the frame 154 and provides a grasping member for lifting the end 160 from the base 100 when engaged.

The blade assembly 150 is configured to rest upon the top surface 172 of the guide track 146 and includes a blade portion (not visible) that fits within a recessed channel 174. The recessed channel 174 includes a cutting channel 176 that forms a slot through the guide track 146 to allow the blade of the blade assembly to cut paper positioned between the underside of the guide track and the top side of the cutting track 130. As the blade assembly 150 is guided by a user along the guide track 146, the engagement of the recessed and cutting channels of the guide track with the blade assembly 150 causes the blade to precisely follow the path of the guide track and cut the paper as prescribed by the shape of recess channel of the guide track 146. The blade assembly 150 is contoured to provide ease of gripping between the thumb and forefinger of a user when grasping the blade assembly 150. Thus, the blade assembly 150 has side recesses formed on opposite sides for holding and guiding the blade assembly 150 by a user.

Figure 2A:
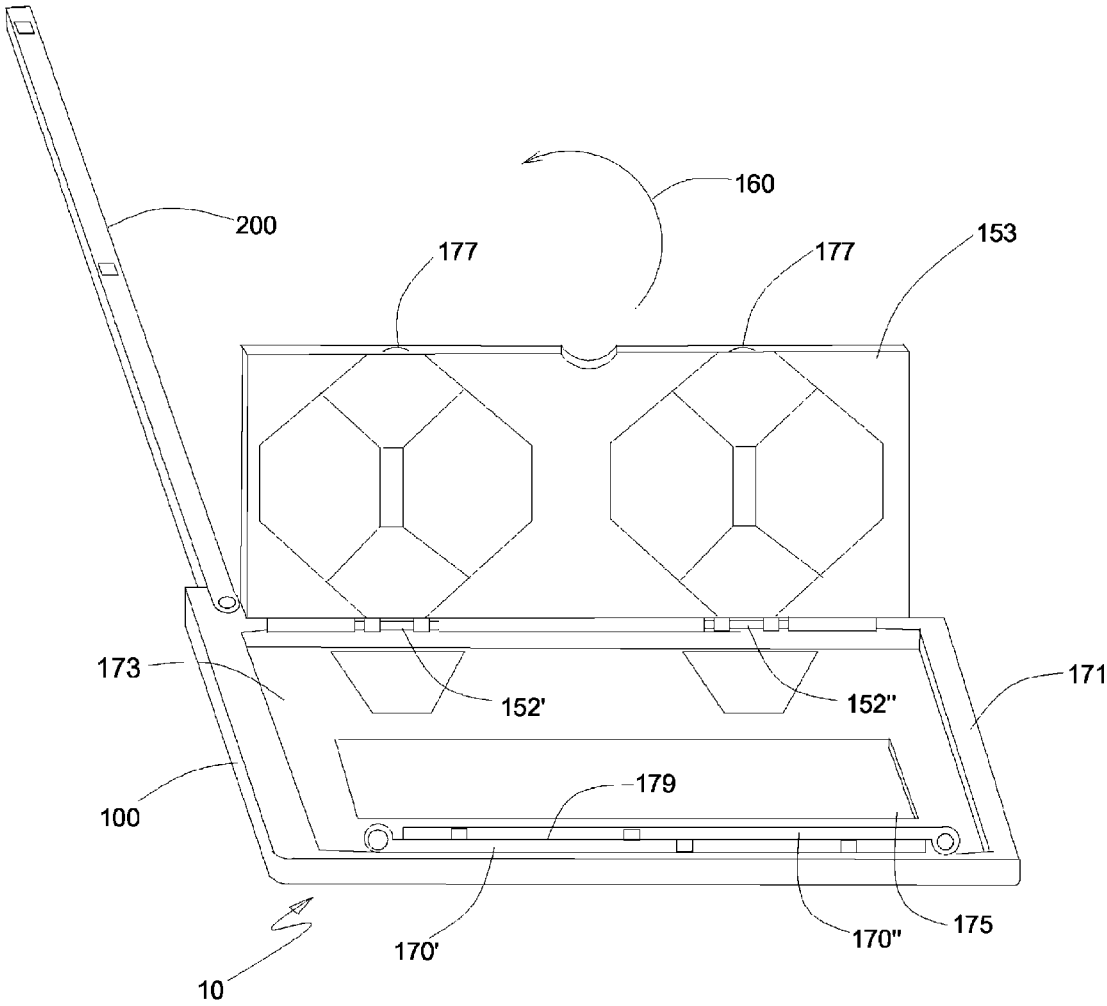
FIGS. 2A and 2B are bottom and top perspective views of details of one planar base for the embodiment of FIG. 1.
Figure 2B:
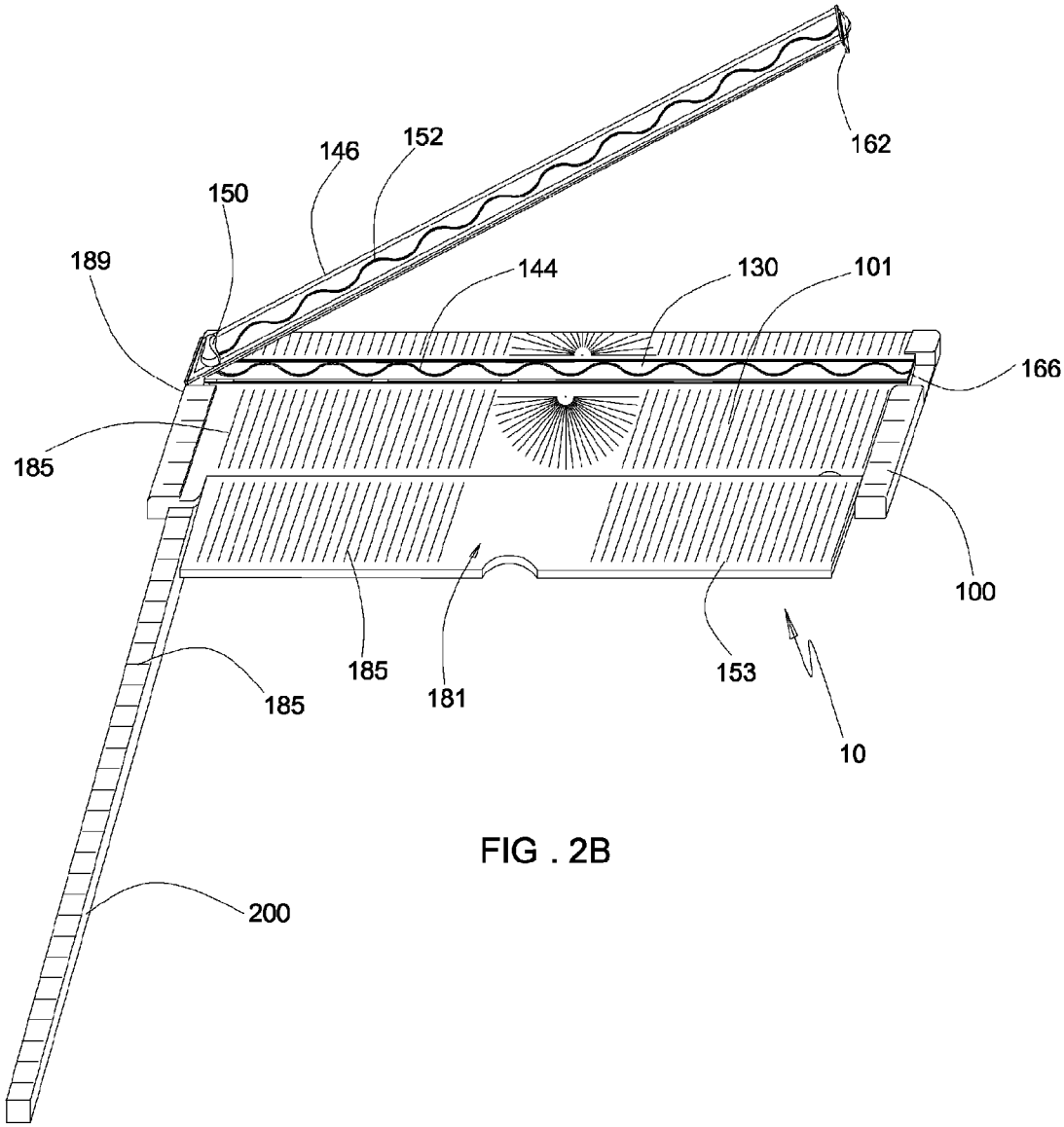

As depicted in FIGS. 2A and 2B, base 100 may include an extension side piece panel 153. In an undeployed position, extension side piece panel 153 may reside below base 100, held there by snap fit within the base 100. To obtain a larger working area, by increasing the size of top surface 101, the side ruler 200 (if present) is pivoted out of recess 103 and extension piece panel 153 is disengaged from the base 100, rotated open as by pivotal rotation around one or more hinges 152' and 152" to result in the larger work surface shown in FIG. 2B. The extension side piece panel 153 is a planar member that is configured to lie in plane with the top surface of the base when fully opened. One or more support arms 170' and 170" may be extended, as by rotation, from base 100 underneath extension plate 150 to provide support for the side piece panel 153 to ensure that the side piece panel 153 lies in planar relationship with the top surface of the base 100 when fully opened. Thus, the effective working area of the top surface 101 may be increased by the size of the extension side piece panel 153 as it is folded out from the bottom of the base 100. The support arms 170 are rotated about their ends to reside at least partially beneath the extension side piece 153 in order to support the side piece 153 horizontally when placed on a support surface, such as a table top. The pivoting open of the side piece 153 can effectively double the size of the working surface of the paper trimmer 10 of the present invention to use and support larger pieces of paper for trimming. The side piece 153 effectively forms a hinged panel that folds over the back 171 of the base 100. The back 171 includes recessed surfaces 173 and 175. The recess 173 is sized and configured to receive the extension panel 153 in a closed position. The panel may include one or more protuberances 177 for snapping into small indents (not visible) in the interior surface wall 179 of the recess 173 to hold the panel 153 in a closed position. The depth of the recess 173 is such that the panel 153 can fully reside in the recess 173 so as to not interfere with usage of the trimmer 10 when the panel is not in use. Additionally, the panel 153 may serve as a door for holding supplies in the recess 175. The recess 175 is provided to hold several sheets of paper for trimming or other supplies, such as paper clips.

As further shown in FIG. 2B, the extension panel 153 serves to widen the working surface 181 so as to support larger sizes of paper sheets. Each of the base 100, side ruler 200 and the panel 153 include markings 185 for assisting the user in providing measurements for the user when cutting a sheet of material with the trimmer 10. The blade guiding track 146 is hingedly mounted to one side 189 of the base 100 and, when positioned over the cutting track 130 in a closed position, snap fits onto the base with the retaining portion 162 engaging the side surface 166 of the base 100. This friction fit engagement holds the guide track 146 to the base 100 and properly aligns the guide track 146 with the cutting track 130 when sliding the blade holder 150 along the cutting groove 152 of the guide track 146 so that the blade (not visible) follows the groove 144 of the cutting track 130.

Figure 3A:
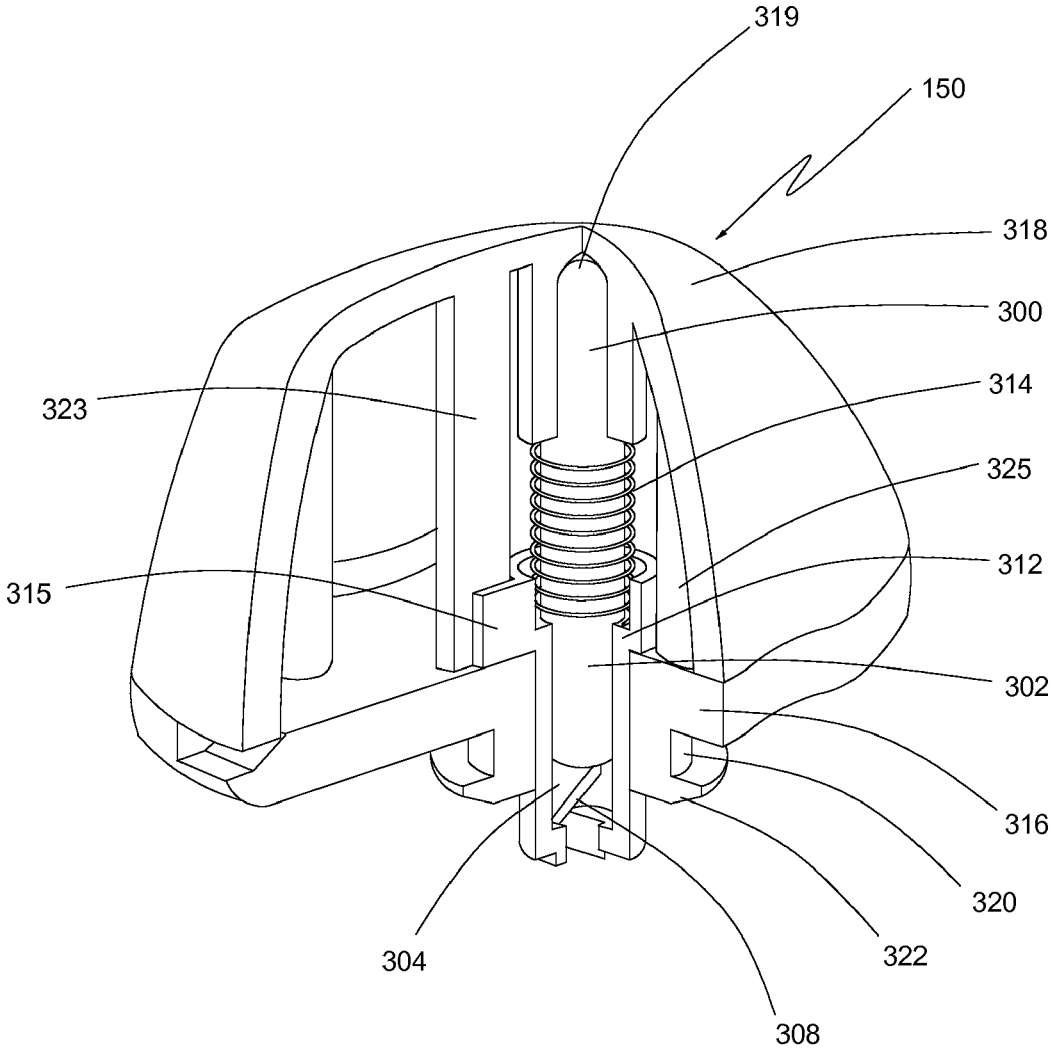
FIG. 3A is a cutaway view of one illustrative embodiment of a paper trimmer blade assembly in accordance with the principles of the present invention.
Figure 3B:
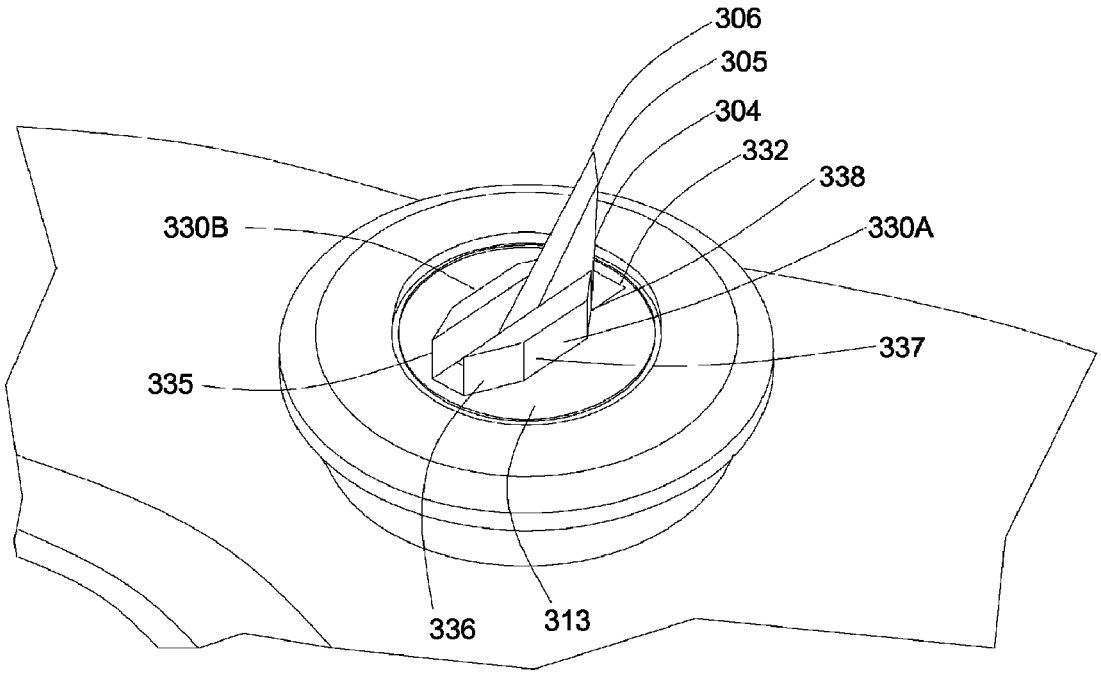
FIG. 3B is a bottom view of a portion of the paper trimmer blade assembly of FIG. 3A.

FIGS. 3A and 3B depict one illustrative embodiment of a paper trimmer blade assembly 30, in accordance with the present invention. A fastener or housing base 316 forms a generally planar lower surface of the assembly 30 from which a neck 320 extends downwards to form a collar 322, which may have an enlarged outer rim for engaging and being retained by the sidewalls of the guide track. The collar 322 is configured to be held within the guide track as the collar 322 is moved along the path of the guide track. That is, the guide track may include a receiving opening 610 (see FIG. 6A) for receiving the collar 322. When the blade assembly is pressed against the receiving opening 610, the inner housing retracts to expose the blade. As the collar 322 is moved into the cutting groove, the bottom rim is held within the guide track such that the assembly 30 is held to and supported by the guide track. The engagement of the collar 322 with the guide track holds the assembly 30 to the track while causing the spring 314 to compress as the blade sleeve 312 is retracted into the body of the assembly 30.

A fastener or housing cover 318 is attached to the housing base 316 enclosing the upper portion of the assembly 30. The housing cover 318 is molded to serve as a handle for movement of the assembly 30 during use. A receiving socket 319 is formed in the underside of housing cover 318 for receiving a proximal end of a shaft 302 of a blade holder 300. The receiving socket 319 forms a cylindrical tube having a semi-spherical end for receiving a proximal end of a blade holder 300 having a similar configuration to allow the blade holder 300 to fit inside and freely swivel within the socket 319.

Blade holder 300 includes a circular shaft 302 with a distal cutting blade 304 held therein. The cutting blade 304 includes a leading edge 308, a distal trailing edge 305 ending at a distal tip 306, and an angled cutting edge 310 extending from the leading edge 308 to the distal tip 306.

In an assembled paper trimmer assembly 30, the proximal end of shaft 302 rotatably resides in the receiving socket 319 in the housing cover 318. In order to accommodate free rotation of the blade holder 300 within the socket 319, the proximal end of the blade holder 300 is semi-spherically shaped. The interior surface of the socket 319 is similar shaped to receive the proximal end of the blade holder 300.

The distal end of the blade holder 300 resides in a hollow tube assembly forming an inner housing or blade sheath 312 which forms a sheath around the blade 304 when the blade 304 is not in use and which moves upwardly into the housing cover when the assembly 30 is in use, such that the engagement of the lower end of the tube 312 engages with the guide channel of the guide track previously describe. This provides an automatic safety feature which causes the blade to retract into the sheath 312 when the trimmer assembly 30 is not engaged with a guide track to prevent exposure of the blade surface when the assembly 30 is not in use. The sheath 312 includes an enclosed planar bottom 313 and an open top for receiving the blade holder 300 therein. The top of the sheath 312 is biased away from the cover 318 by the spring 314. The spring 314 abuts the bottom of receiving socket 319 and resides within a portion of and abuts the top of the tube 312 to bias against the top of the tube 312 away from the socket 319 and to push the tube 312 downwards for covering the blade 304. Bottom end 313 includes a slot-like opening 332 through which cutting blade 304 may extend when the tube 312 is retracted into the assembly 30.

As shown in FIG. 3B with the blade 304 in an extended or exposed cutting position, two parallel guides 330A and 330B are formed as protruding members with flat bottoms that are disposed on the bottom 313 of sheath 312 and which run generally parallel to slot-like opening 332. The inner sidewall 335 of each parallel guide 330 may be formed as a planar wall parallel to a long axis of the slot like opening 332 and may be inline therewith. The outer sidewall has a relatively flat mid-section 337, a tapered front portion 336 and a tapered rear portion 338 to facilitated sliding of the guides 330 through a guide slot of the present invention. As discussed further herein, the shape of guide 330 acts to guide the cutting blade in operation. Thus, the tube 312 and the blade 304 are configured to rotate together as dictated by the shape of the cutting groove employed.

Referring again to FIG. 3A, an abutment tab 315 depends from the tube 312 to limit over rotation of the blade 304 relative to the housing cover 318. The tab 315 is configured to be rotatable over a ninety degree angle, between internal abutment structures 323 and 325 of the housing cover 318. This helps to ensure that the blade is pointing in a generally forward direction when inserting the blade into a guide track of the present invention. If an abutment tab 315 is not provided on the sheath 312, the blade 304 can be configured to freely rotate 360 degrees along with the sheath 312.

Figure 4:
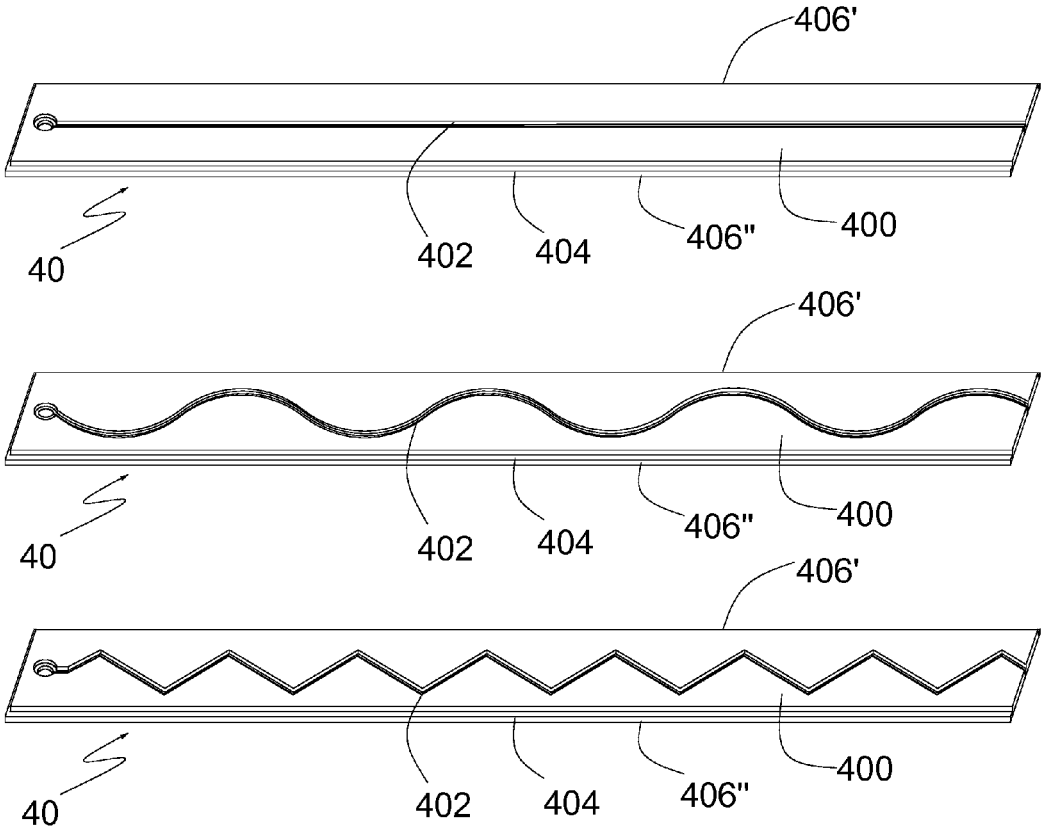
FIG. 4 is a perspective view of several embodiments of recessed cutting tracks for a paper trimmer assembly in accordance with the principles of the present invention.

Turning to FIG. 4, several embodiments of recessed cutting tracks 40 in accordance with the present invention are depicted. Each recessed cutting track 40 is formed as an elongated planar member with a cutting groove 402 recessed into the top surface 400. Each cutting groove 402 is sized to receive distal tip 306 of cutting blade 304 therein. The depth of each cutting groove being slightly greater than the depth of the cutting blade 304 into the groove so that the blade 304 does not contact the groove, that would otherwise tend to dull the blade, but that allows the blade to cut through a sheet of material residing on the top surface 400. The groove 402 extends along the long axis of the track 40, in the pattern to be followed by the cutting blade 304 that matches the pattern of a corresponding cutting guide of the present invention.

Additionally, each recessed cutting track 40 includes connection structures allowing it to be placed into the base 100 for usage. For example, one or more protruding tabs, which may form an entire shelf or step 404, may be formed along the long edges 406' and 406" of the cutting track 40 to allow the cutting track 40 to be slidably engaged with the base 100.

Figure 5:
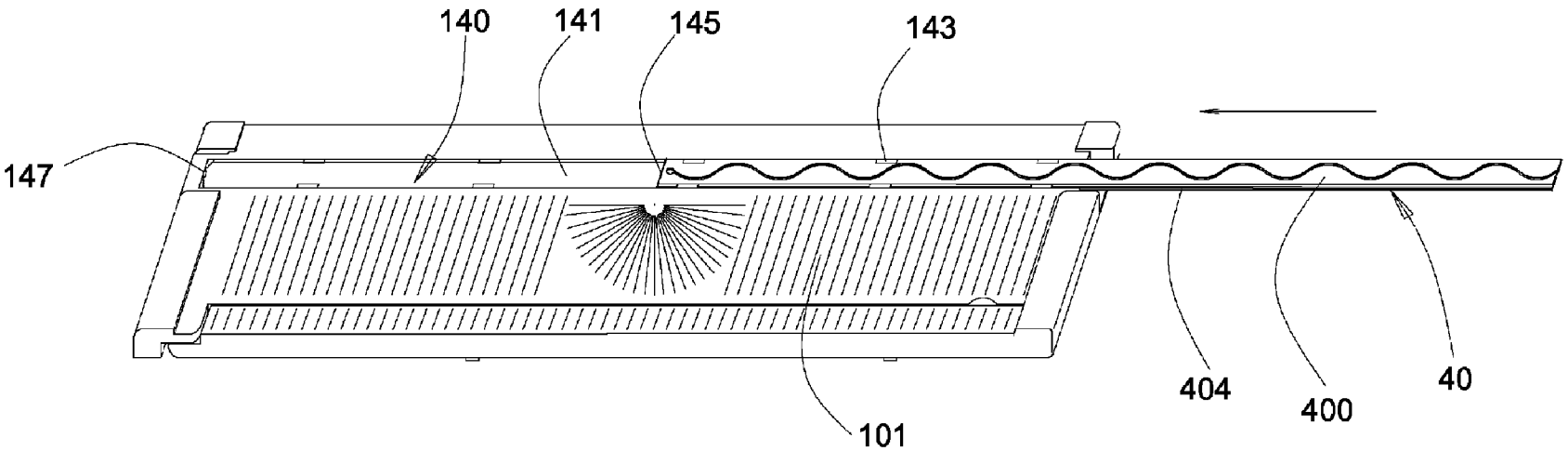
FIG. 5 is a perspective view of a recessed cutting track of FIG. 4 being inserted into a base for a paper trimmer assembly in accordance with the principles of the present invention.

As depicted in FIG. 5, this allows a cutting track 40 to be inserted, as indicated by the arrow, into a counterpart receiving channel or slot 140 in base 100, such that upper surface 400 is generally coplanar with top surface 101 and each protruding tab or step 404 is sliding in an opposite groove 141 to be retained therein by an overhanging portion, such as tabs 143 protruding from the side walls of the slot 140. The track 40 is inserted until its distal end 145 abuts with and engages the distal end 147 of the slot 140.

Figure 6A:
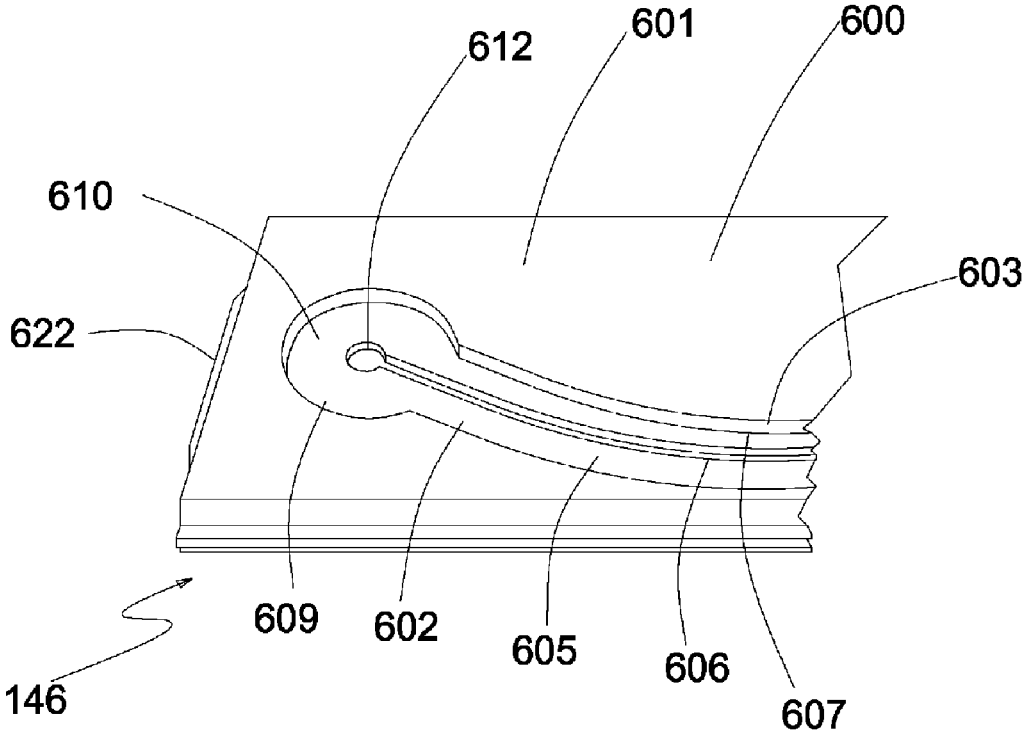
FIGS. 6A and 6B are close up views of a guide track for guiding a paper trimmer blade assembly in accordance with the present invention.
Figure 6B:
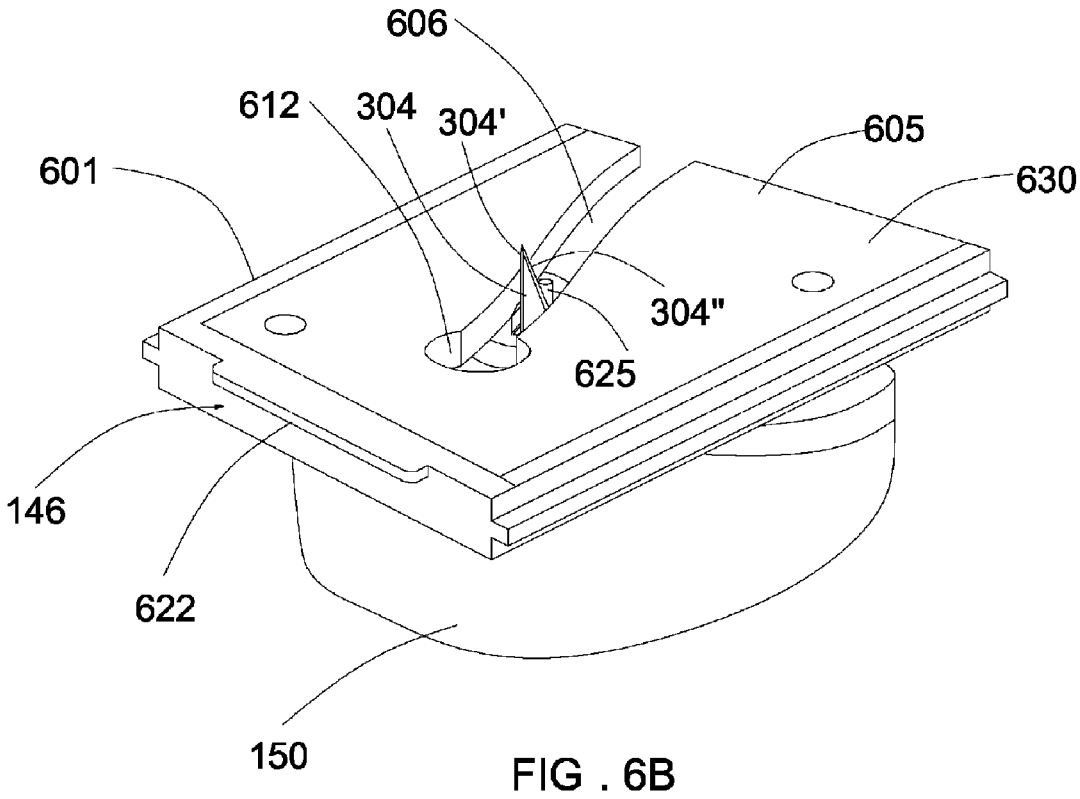

FIGS. 6A and 6B are close up views of a guide track 146 for guiding the paper trimmer assembly 30 during use. Guide track 146 is formed as a generally elongated planar member having an upper surface 600 and a lower surface 630. The guide track 146 is formed from two planar members 601 and 605, with member 601 forming the guide channel 602 and the member 605 fitting within the member 601 and forming the cutting channel 606. The inner edge of the guide channel 602 may be angled such that a groove 607 is formed between the side wall 603 defining the guide channel 602 and the top surface 609 of the member 605. The groove 607 may be sized to receive the collar of the blade trimmer assembly of the present invention. The recessed guide channel 602 formed in the upper surface 600 is provided with a planar bottom surface 604 formed by the top surface 609 of the member 605 and the surrounding sidewall 603. A cutting channel 606 is formed within the recessed channel 602 as an elongated slot-like opening matching the pattern of the recessed channel 602. An insertion point formed by recess 610 for cutting blade assembly 30 may be formed as an enlarged portion of the recessed channel 602, with a similarly enlarged portion 612 of cutting channel 606 formed therein.

As best depicted in FIG. 6B, when cutting blade assembly 30 is mounted in a guide track 146, the parallel guides 330A and 330B contact bottom planar surface 604 of the recessed channel 602. Tube assembly 312 retracts upwards, compressing spring 314. Cutting blade 304 extends through the cutting channel 606 beyond lower surface 630 so as to be exposed for cutting a sheet of material that is abutted against the lower surface 630. The cutting blade 304 may be provided with dual cutting edges 304' and 304" to allow cutting in either direction such that the cutting blade assembly 30 may be employed to cut along guide track 146 in two directions.

Parallel guides 330A and 330B fit within the recessed channel 602, such that relatively flat sections 337 align with the sidewall 603 on opposite sides of the channel 602. As the cutting blade assembly 30 is slidably moved in the guide track 146, where recessed channel 602 curves, the tapered front and rear portions 336 and 338 of the parallel guides 330 interact with the sidewall 603, causing tube assembly 312 and cutting blade 304 to rotate. Cutting blade 304 thus follows along cutting channel 606. A rounded insertion point 610 allows the blade assembly 30 to properly align following insertion. Likewise, the width of the cutting channel 606 could be configured to receive the parallel guides 330A and 330B therein for guiding the parallel guides and thus the blade along the cutting channel 606. The parallel guides 330*a* and 330B allow the cutting blade to move along the cutting channel 606 without engaging or cutting into the cutting channel 606. It is also contemplated according to the principles of the present invention, as shown in FIG. 6B, that a single guide 625 could be positioned directly in front or behind (or both in front and behind by using two guides) the cutting blade such that the blade guide extends into the cutting channel 606 when cutting forcing the cutting blade to follow the cutting channel 606.

Each long edge of guide track 146 includes an attachment structure, allowing it to be mounted for use in a system in accordance with the principles of the present invention. For example, in the depicted embodiment, an elongated tab 620 is disposed along each long edge. Similarly, the short edges may also contain attachment structures, such as protruding tab 622, which interact with other complementary mounting structures 622' as discussed further herein.

Figure 6C:
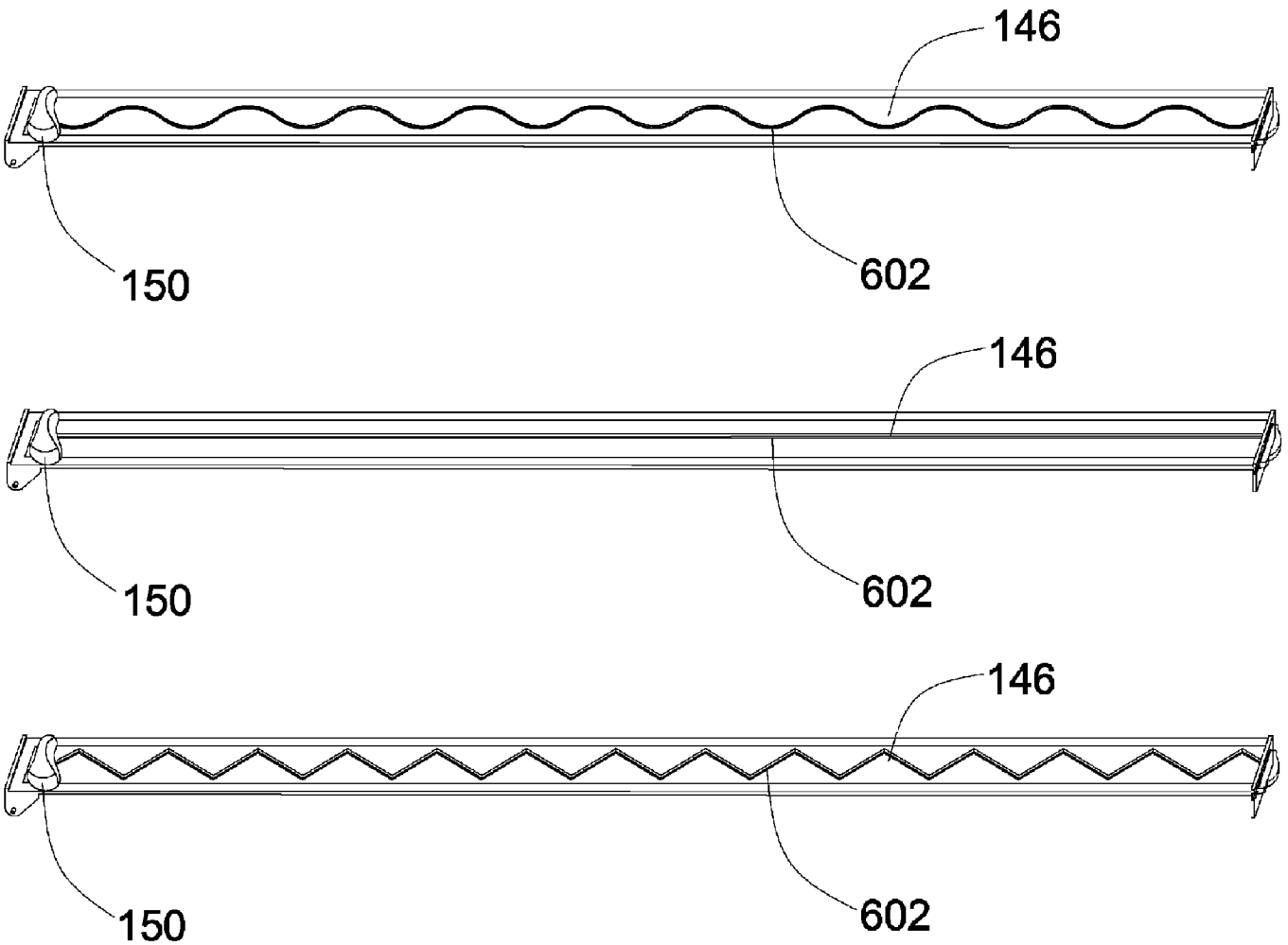
FIG. 6C is a perspective view of several embodiments of guide tracks for a paper trimmer assembly in accordance with the principles of the present invention

Turning to FIG. 6C, several embodiments of guide tracks 146 in accordance with the present invention are depicted. Each guide track 146 has a recessed channel 602 with a different pattern. By selecting matching guide tracks 146 and cutting tracks 40 (previously described) a paper trimmer system 10 utilizing a cutting blade assembly 30 in accordance with the present invention may be used to cut different selected patterns into sheet material, such as paper.

Figure 7A:
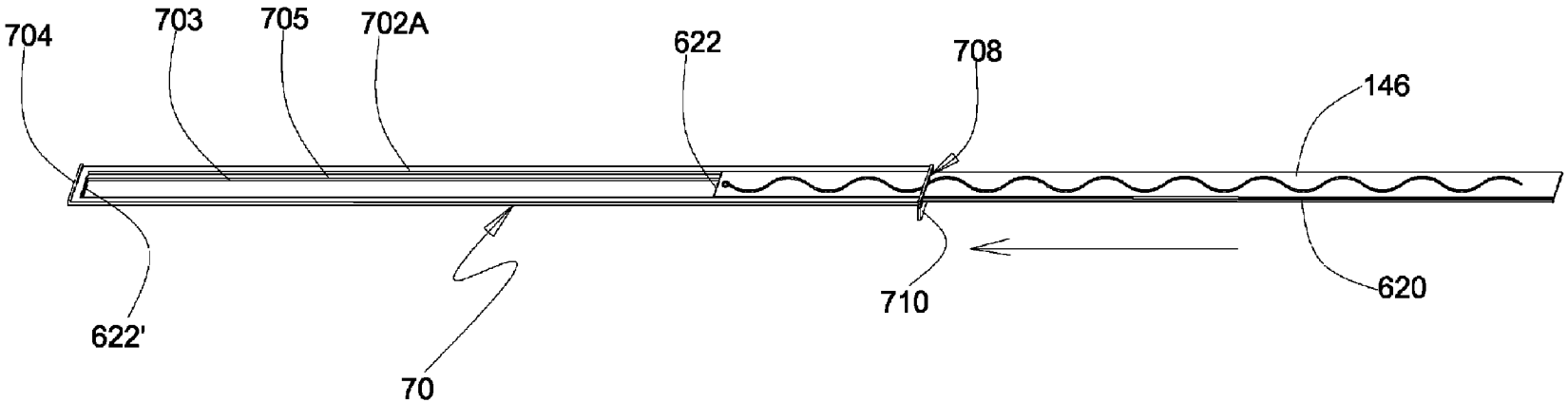
FIGS. 7A and 7B depict a guide track being inserted into a mounting frame for use with a paper trimmer assembly of the present invention.
Figure 7B:
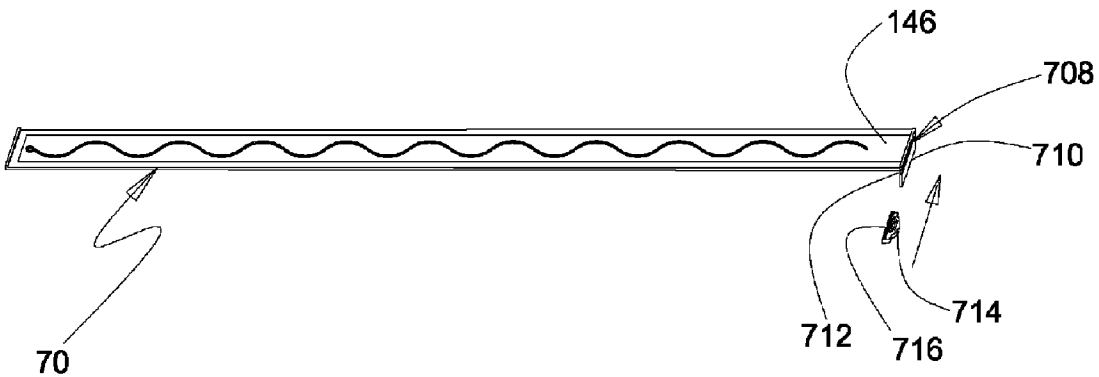

FIGS. 7A and 7B depict one embodiment of a mounting frame 70 for guide track 146. Mounting frame 70 includes a first end 710 which is connected to an opposite second end 704 by two connecting rails 702A and 702B, which run parallel to a long axis of the mounting frame 70. The inner facing walls 703 of each connecting rail 702 contain structures for receiving and retaining a guide track 146 therein. In the depicted embodiment, for example, a slot 705 for receiving the elongated tab 620 of the guide track 146 is disposed on the inner facing wall 703 and aligns with an insertion opening 708 formed in first end 710.

As depicted in FIG. 7A, the guide track 146 may be slidably inserted into the mounting frame 70 through insertion opening 708, with elongated tabs 620 entering slots 705 to hold the track 146 within the frame 70. The guide track 146 may be fully inserted until the inserted end contacts the inner surface of second end 704. Protruding tab 622 may reside in an insertion slot 705 disposed therein. A retainer 714 may be attached to first end 710, as by sliding a ridged tab 716 in a keeper slot 712, to retain guide track 146 in the mounting frame 70. The retainer 714 thus transversely engages the end 710 of the frame 70 and covers the insertion opening 708 to prevent the track 146 from being inadvertently removed from or moved within the frame 70 when in use. The retainer 714 may be held in the slot 712 in the end 710 by friction fit.

Figure 8:
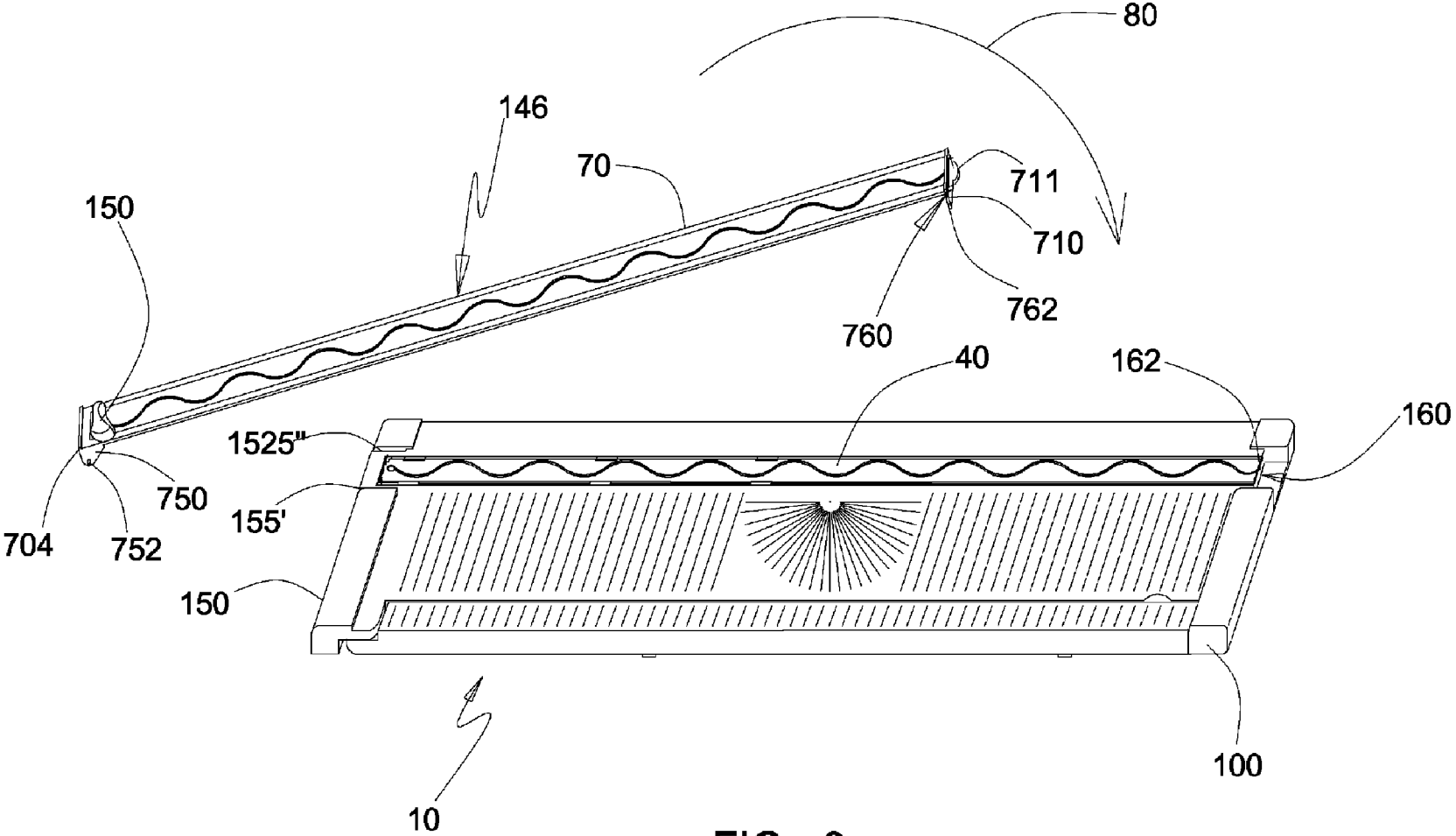
FIG. 8 depicts the attachment of a mounting frame assembly with an inserted guide track to a planar base in accordance with the present invention.

FIG. 8 depicts a mounting frame 70 with an inserted guide track 146 being attached to a base 100 with an inserted recessed cutting track 40 inserted into the receiving channel of the base 100. Second end 704 of mounting frame 70 has a pair of downwardly depending mounting tabs 750 that each include mounting pivot pins 752, in the form of protrusions on the outer face thereof. The mounting tabs 750 are planar walls, one positioned on each side of the frame 70, and each having a curved edge with a mounting pin 752 generally lying in the center of the radius formed by the curved edge. The mounting tabs 750 are parallel to each other and parallel to the longitudinal axis of the mounting frame 70, depending downwardly from the second end 704. In order to mount the frame 70 to the base 100, the mounting tabs 750 are inserted into respective counterpart receiving slots 155' and 155" formed in the side of base 100. The slots 155' and 155" are provided with detents for receiving the pivot pins 752. Conversely, the frame may be provided with recesses or detents 752 and the slots 155' and 155" may be provided with protruding pivot points for engaging the detents 752. The interaction between the detents and the protruding pivot points allows the frame 70 to be held relative to the base 100 while the frame 70 can be freely pivoted relative to the base.

The first end 710 of mounting frame 70 includes a downwardly depending transversely extending portion or wall 760 that includes one or more mounting clips or protrusions 762 on the inner face thereof which interact with counterpart receiving structures 162 on the opposite side of base 100 disposed within a recess 160. When the frame is fully closed relative to the base 100 such that the protrusions 762 engage the receiving structures 162, the frame lies in parallel to the cutting track 40 and is held in place relative to the base 100 until the user grasps and lifts the grasping tab 711 on the first end 710. In some embodiments, the mounting frame 70 may be installed by being placed in the appropriate position over base 100 and being pressed downwards thereover. In other embodiments, the mounting clips 752 on second end 704 and the receiving structures 155' and 155" may interact in a rotatable manner (as where receiving structures 155' and 155" are slots including a rounded projection, such as a bar or circular projections, therein and mounting clips 752 rotate on such a rounded projection) and the second end 704 may be attached by insertion of the mounting clips 752 into or onto the receiving structures 152 and first end 710 rotated downwards, as depicted by arrow 80 to complete installation of the mounting frame 70.

Upon installation, mounting frame 70 is securely attached to the base 100. Guide track 146 attached to the mounting frame 70 is positioned directly over recessed cutting track 40. Paper or other sheet-like material to be cut may be placed underneath the mounting frame 70 and over recessed cutting track 40, by insertion there between. Such sheet-like material may then be cut by movement of blade assembly 150 along guide track 60. Upon such movement, the parallel guides 330A and 330B interact with the sidewalls of recessed cutting track 40, causing tube assembly 312 and cutting blade 304 to rotate and the cutting blade 304 to follow along cutting channel 604. Also, because the guide track 146 is formed from a deflectable material, such as a flexible plastic or metal, as the user applies downward pressure to the cutter assembly 30, the paper or other sheet material being cut is held in place between the cutting guide 146 and the cutting track 40 to prevent movement of the paper while cutting. This allows the selected pattern to be cut without tearing the paper.

The embodiment of a paper trimmer assembly of the present invention is provided by way of example and not limitation. The operation process of this invention is not limited to the above-mentioned embodiments; any change, decoration or substitute without deviating from the concept and technology of this invention is an equivalent replacement, and is included within the protection range of this invention. Thus, while the methods and apparatus of the present invention have been described with reference to certain illustrated embodiments to show and describe what is believed to be the best mode of the invention, it is contemplated that upon review of the present invention, those of skill in the art will appreciate that various modifications and combinations may be made to the present embodiments without departing from the spirit and scope of the invention as recited in the claims. The claims provided herein are intended to cover such modifications and combinations and all equivalents thereof. Reference herein to specific details of the illustrated embodiments is by way of example and not by way of limitation.

What is claimed is:

1. An apparatus for trimming sheet material, comprising:

a planar base;

at least one a removable cutting track having an upper surface coplanar with a surface of the planar base and a defining a blade receiving channel having a selected pattern formed in the upper surface;

a removable guide track positioned above the at least one cutting track, the guide track having a first channel in a top surface of the guide track substantially matching the pattern of the blade receiving channel and a second channel also substantially matching the pattern of the blade receiving channel, the first and second channels being substantially aligned with the blade receiving channel and extending through the guide track, the second channel being more narrow than the first channel to define a planar surface between the first channel and second channel extending along and adjacent to the second channel;

a blade assembly comprising an outer housing, a cutting blade having a cutting surface slanting upwards from a lower leading edge to an upper trailing edge and one or more channel guides adjacent the cutting blade, the cutting blade being pivotably mounted in the outer housing blade assembly with the cutting blade being rotatable around an axis parallel to a longitudinal axis of the cutting blade, the one or more channel guides positionable within the second channel when a bottom surface of the blade assembly contacts the planar surface of the guide track.

2. The apparatus of claim 1, wherein the one or more channel guides adjacent the cutting blade are disposed on a lower surface of a retractable inner housing that at least partially surrounds the cutting blade, the inner housing being biased toward the cutting edge of the cutting blade.

3. The apparatus of claim 2, wherein the inner housing is retractable into the outer housing upon insertion into the first channel, with the cutting blade at least partially extending through a distal end of the inner housing and beyond the one or more channel guide.

4. The apparatus of claim 3, wherein the outer housing further comprises a collar having an enlarged outer rim that at least partially surrounds the inner housing, the outer rim positioned within and slidable along the guide channel with the first channel adjacent the collar to maintain the housing relative to the guide track while cutting.

5. The apparatus of claim 4, wherein the one or more channel guides comprises a pair of channel guides each forming a protrusion on the lower surface of the inner housing having an inner edge parallel to the cutting blade and an outer edge with a tapered front portion and a tapered rear portion, such that as the inner housing is slidably moved relative to the guide track, the tapered front and rear portions of each channel guide interact with a wall of the second channel, causing the inner housing and the cutting blade to rotate relative to the outer housing thus allowing the cutting blade to move along the second channel without cutting into the second channel.

6. A paper trimmer assembly comprising:

a cutting track having a planar upper surface and a receiving channel formed in the upper surface, the receiving channel defining a selected pattern;

a guide track positionable over the cutting track, the guide track defining a first channel substantially matching a shape of the selected pattern and extending through the guide track;

a blade assembly comprising an outer housing, an inner housing biased within the outer housing and a cutting blade pivotally mounted within the outer housing, the outer housing having a bottom surface engaging the guide track and the inner housing having at least one blade guide disposed on a distal end thereof, the at least one blade guide positioned proximate the cutting blade and within the first channel when the bottom surface engages the guide track and the inner housing is retracted relative to the outer housing to expose the cutting blade, the at least one blade guide guiding the cutting blade through the first channel and preventing the cutting blade from cutting into the first channel of the guide track.

7. The assembly of claim 6, further comprising a blade holder having an elongate, substantially cylindrical shape with the cutting blade extending from a first end of the blade holder, the outer housing further comprising a receiving socket having a generally cylindrical shape for receiving a second end of the blade holder and allowing the blade holder to freely swivel therein.

8. The assembly of claim 6, wherein when the bottom surface of the outer housing is forced against the guide track and the at least one blade guide is inserted into the at first channel, the inner housing moves from a first, fully extended position in which the inner housing surrounds a distal end of the cutting blade to a second, retracted position to at least partially expose the cutting blade through a distal end of the inner housing beyond the at least one channel guide.

9. The assembly of claim 6, wherein the at least one blade guide comprises a pair of blade guides defining a blade slot therein between, each blade guide disposed on an opposite side of the cutting blade when the cutting blade extends through the blade slot and the pair of blade guides are positioned within the first channel to guide the blade through the channel while cutting.

10. The assembly of claim 9, wherein the pair of blade guides each comprise a protrusion on a lower surface of a retractable tube assembly having an inner edge parallel to the cutting blade and an outer edge with a tapered front portion and a tapered rear portion, such that as the blade assembly is slidably moved in the guide track, the tapered front and rear portions of each blade guide interact with a wall of the recessed channel, causing the retractable tube assembly and the cutting blade to rotate.

11. The assembly of claim 6, wherein the guide track further defines a second channel circumscribing the first channel and substantially matching a shape of the selected pattern, the second channel partially extending into the guide track to form a recessed planar surface around the first channel and wherein the outer housing further comprises a collar surrounding said inner housing, a distal end of the collar engaging the recessed planar surface and having a width to substantially match a width of the second channel, engagement of the collar within the second channel guiding the outer housing along the second channel as the collar is slid along the second channel.

12. The assembly of claim 11, wherein the collar further comprises an enlarged rim on a distal end thereof and wherein the second channel is spaced from the recessed planar surface to form a guide channel therein between, the enlarged rim having a width that is greater than a width of the second channel so that when the enlarged rim of the collar is positioned within the guide channel, the outer housing is retained relative to the guide track and is allowed to slide relative thereto.

* * * * *